US009676093B2

(12) United States Patent
Euloth

(10) Patent No.: US 9,676,093 B2
(45) Date of Patent: Jun. 13, 2017

(54) BODY CARE TOOL

(71) Applicant: Philip M. Euloth, Dartmouth (CA)

(72) Inventor: Philip M. Euloth, Dartmouth (CA)

(73) Assignee: HALIFAX BRUSH HANDLE INC., Dartmouth, Nova Scotia (CA)

( * ) Notice: Subject to any disclaimer, the term of this patent is extended or adjusted under 35 U.S.C. 154(b) by 284 days.

(21) Appl. No.: 14/319,704

(22) Filed: Jun. 30, 2014

(65) Prior Publication Data

US 2015/0027280 A1 Jan. 29, 2015

(30) Foreign Application Priority Data

Jul. 25, 2013 (CA) ..... 2822155

(51) Int. Cl.

| | |
|---|---|
| ***B25G 1/10*** | (2006.01) |
| ***A47K 7/02*** | (2006.01) |
| ***A46B 5/02*** | (2006.01) |
| ***A46B 7/04*** | (2006.01) |

(52) U.S. Cl.

CPC ..... *B25G 1/102* (2013.01); *A46B 5/021* (2013.01); *A46B 7/042* (2013.01); *A46B 7/044* (2013.01); *A47K 7/022* (2013.01); *A46B 2200/102* (2013.01)

(58) Field of Classification Search

CPC ..... B25G 1/102; A46B 7/044; A46B 7/042; A46B 5/021; A46B 2200/102; A47K 7/022

USPC ..... 401/7, 8; 16/430; 15/143.1

See application file for complete search history.

(56) References Cited

U.S. PATENT DOCUMENTS 1,379,925 A * 5/1921 Kawasaki ..... A47K 7/022 15/222
2,603,865 A * 7/1952 Sneed ..... B26B 19/00 30/232
2,770,071 A * 11/1956 Endres ..... A47K 5/05 401/8
2,914,785 A * 12/1959 Ela ..... A46B 5/02 15/111
4,226,418 A * 10/1980 Balfour ..... A63B 49/08 16/DIG. 12
4,542,585 A * 9/1985 Ito ..... B26B 19/06 16/430
D324,455 S * 3/1992 Fasitta ..... D4/104
5,146,810 A * 9/1992 Mueller ..... B26B 13/20 30/232
5,251,990 A * 10/1993 Vought ..... A45D 34/04 15/222
5,528,792 A * 6/1996 Nazemi ..... A46B 5/0083 15/143.1
5,609,175 A * 3/1997 Gerry ..... A01K 87/08 135/15.1
5,659,916 A * 8/1997 Beatty ..... A45D 34/04 15/143.1

(Continued)

*Primary Examiner* — David B Thomas
(74) *Attorney, Agent, or Firm* — Thompson Hine LLP

(57) ABSTRACT

A body care tool comprises a body interacting structure for interacting with a surface portion of the body. A handle is connected to the body interacting structure. The handle has a plurality of finger apertures disposed therein. Each finger aperture is designed for accommodating one finger of a user of the body care tool therein such that the user is enabled to handle the body interacting structure using two or more fingers inserted into the finger apertures.

7 Claims, 8 Drawing Sheets

(56) References Cited

U.S. PATENT DOCUMENTS 5,735,691 A * 4/1998 Fetter ..... A46B 17/02 15/145
5,822,825 A * 10/1998 West ..... A47L 1/16 15/236.01
5,870,826 A * 2/1999 Lewan ..... A45D 29/02 30/28
5,875,511 A * 3/1999 Nejdl ..... A47K 7/028 15/176.1
6,210,057 B1 * 4/2001 Yannaci ..... A45D 34/042 401/150
6,237,194 B1 * 5/2001 Williams ..... A47G 21/08 15/443
6,286,173 B1 * 9/2001 Briones ..... A46B 5/0012 15/143.1
6,481,443 B1 * 11/2002 Moore-Johnson ... A45D 29/007 132/73
6,732,411 B2 * 5/2004 Vidal ..... B25G 1/102 16/430
7,017,236 B2 * 3/2006 Vidal ..... B25G 1/102 16/421
D533,354 S * 12/2006 Huller ..... D4/127
7,309,180 B2 * 12/2007 Russell ..... A45D 34/041 401/1
7,480,964 B2 * 1/2009 Vidal ..... B25G 1/102 16/110.1
8,020,242 B2 * 9/2011 Dow ..... A47K 7/028 15/143.1
8,042,216 B2 * 10/2011 Jochim ..... A46B 5/02 119/615
D703,957 S * 5/2014 Parsons ..... D28/63
8,839,521 B2 * 9/2014 Hazard ..... A45D 24/36 30/291
8,967,898 B1 * 3/2015 Dayeh ..... A47K 7/028 401/188 R
9,021,662 B1 * 5/2015 Jones ..... B25G 1/102 16/422
2002/0124340 A1 * 9/2002 Nolan ..... A47K 7/022 15/160
2007/0028727 A1 * 2/2007 Schiller ..... B25B 13/14 81/177.3
2007/0124880 A1 * 6/2007 Petner ..... A46B 5/02 15/143.1
2008/0127459 A1 * 6/2008 Burke ..... A63B 53/14 16/426
2009/0144921 A1 * 6/2009 Newsome ..... A46B 5/02 15/143.1
2009/0314304 A1 * 12/2009 Jochim ..... A46B 5/02 132/126
2010/0043606 A1 * 2/2010 Wang ..... B25G 3/00 81/489
2010/0287736 A1 * 11/2010 Ameduri ..... A63B 49/08 16/430
2012/0167322 A1 * 7/2012 Jaworski ..... A47K 7/022 15/144.1
2013/0180084 A1 * 7/2013 Edson ..... A45B 9/02 16/430
2014/0251358 A1 * 9/2014 Temple ..... A45D 24/14 132/149
2014/0373862 A1 * 12/2014 Prokop, III ..... A45D 24/14 132/150
2015/0183109 A1 * 7/2015 Stevens ..... B25G 1/102 16/422

* cited by examiner

BODY CARE TOOL

This application claims priority to Canadian Patent Application No. 2,822,155, filed on Jul. 25, 2013 and entitled Body Care Tool, the entire contents of which are hereby incorporated by reference.

FIELD

The present invention relates to tools for body care, and more particularly to a body care tool that facilitates handling for users having reduced gripping capability.

BACKGROUND

With the aging of the population in industrialized countries there are an increasing number of people suffering from deformations, chronic pain, and other impairments of the hands and wrists, due to injuries or various diseases such as rheumatoid arthritis. Such impairments often render it difficult or impossible to grip and effectively handle body care tools such as, for example, a brush, a sponge, a scrubber, or a massaging body brush.

For many people it is a humiliating and demoralizing experience having to ask for assistance for performing tasks related to personal hygiene such as having a shower or a bath. Unfortunately, body care tools—in particular, body care tools having a sufficient length for enabling a user to reach various portions of his/her back—require strength to grip the handle thereof and hold it firmly for proper handling, making it difficult or impossible for people having impairments of the hands and wrists to perform one of the most common everyday activities without assistance.

It is desirable to provide a body care tool having a handle that enables people having impairments of the hands and wrists to properly handle the tool.

It is also desirable to provide a body care tool having a handle that is simple and easy to use for people having impairments of the hands and wrists to properly handle the tool.

It is also desirable to provide a body care tool having a handle that enables people having impairments of the hands and wrists to handle the tool with their fingers and obviates the need to grip the handle.

SUMMARY

Accordingly, one object of the present invention is to provide a body care tool having a handle that enables people having impairments of the hands and wrists to properly handle the tool.

Another object of the present invention is to provide a body care tool having a handle that is simple and easy to use for people having impairments of the hands and wrists to properly handle the tool.

Another object of the present invention is to provide a body care tool having a handle that enables people having impairments of the hands and wrists to handle the tool with their fingers and obviates the need to grip the handle.

According to one aspect of the present invention, there is provided a body care tool. The body care tool comprises a body interacting structure for interacting with a surface portion of the body. A handle is connected to the body interacting structure. The handle has a plurality of finger apertures disposed therein. Each finger aperture is designed for accommodating one finger of a user of the body care tool therein such that the user is enabled to handle the body interacting structure using two or more fingers inserted into the finger apertures.

According to one aspect of the present invention, there is provided a body care tool. The body care tool comprises a body interacting structure for interacting with a surface portion of the body. A handle is connected to the body interacting structure. The handle has a plurality of finger apertures disposed therein. Each finger aperture is designed for accommodating one finger of a user of the body care tool therein such that the user is enabled to handle the body interacting structure using two or more fingers inserted into the finger apertures. The body interacting structure is designed to interact with the surface portion of the body by moving the same in a plane of operation oriented approximately parallel to the surface portion of the body. A longitudinal axis of the finger apertures is oriented approximately parallel to the plane of operation.

One advantage of the present invention is that it provides a body care tool having a handle that enables people having impairments of the hands and wrists to properly handle the tool.

A further advantage of the present invention is that it provides a body care tool having a handle that is simple and easy to use for people having impairments of the hands and wrists to properly handle the tool.

A further advantage of the present invention is that it provides a body care tool having a handle that enables people having impairments of the hands and wrists to handle the tool with their fingers and obviates the need to grip the handle.

BRIEF DESCRIPTION OF THE DRAWINGS

An embodiment of the present invention is described below with reference to the accompanying drawings, in which.

DETAILED DESCRIPTION

Figure 1A:
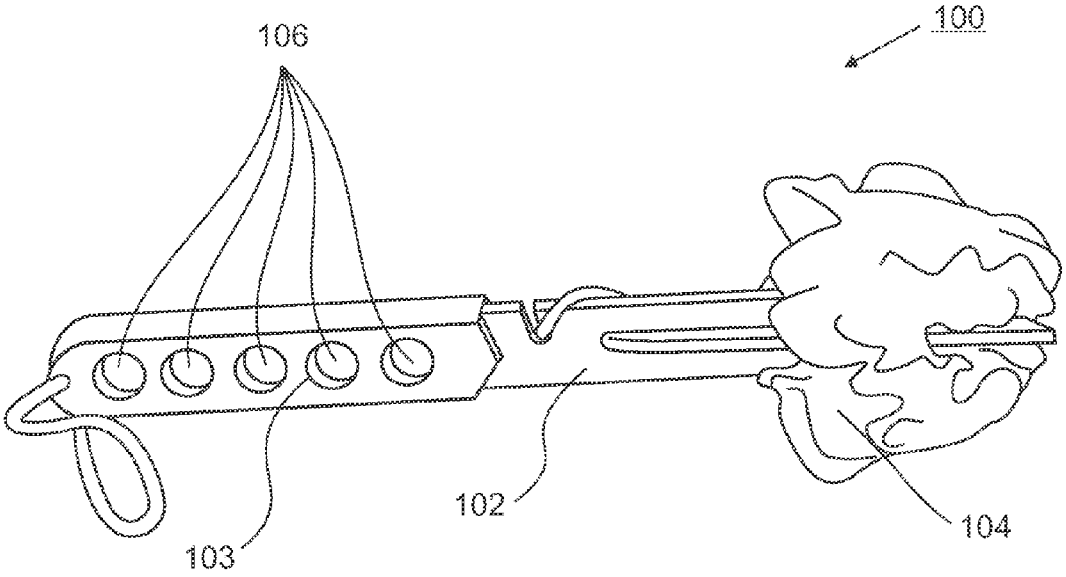
FIG. 1*a* is a simplified block diagram illustrating a perspective side view of a body care tool according to an embodiment of the invention.
Figure 1B:
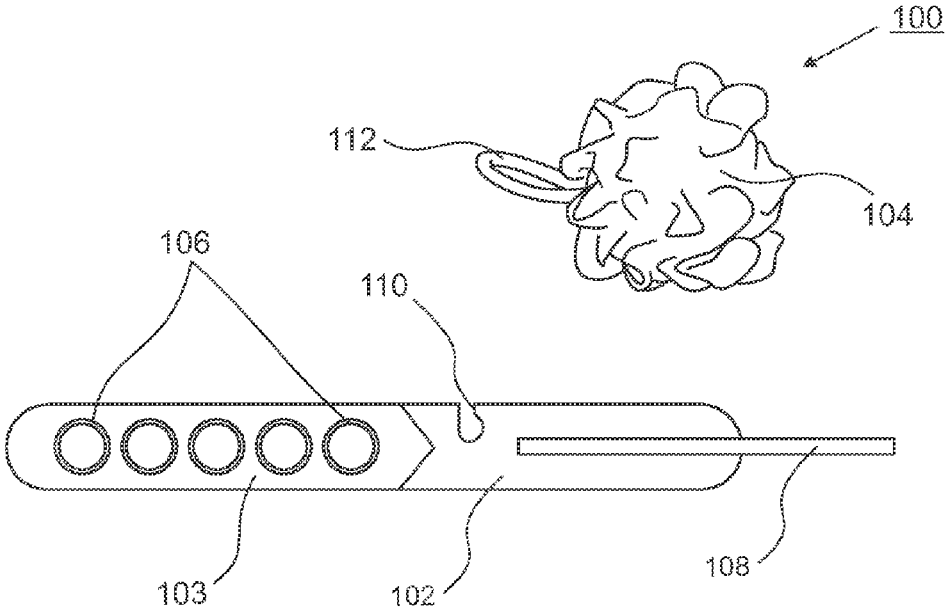
FIG. 1*b* is a simplified block diagram illustrating a side view of the body care tool according to an embodiment of the invention illustrated in FIG. 1*a* with the body interacting structure removed from the handle.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, certain methods and materials are now described.

While the description of the embodiments hereinbelow is with reference to a scrubber for personal hygiene, it will become evident to those skilled in the art that the embodiments of the invention are not limited thereto, but are also applicable for various other body care tools such as, for example, brushes, sponges, or massaging devices, as well as some tools for other purposes than personal hygiene such as, for example, pet grooming, or house cleaning.

Of course, as will become evident to those skilled in the art, use of the body care tool disclosed hereinbelow is also advantageous for people without impairments of the hands and wrists by providing increased handling capability and ease of use.

Referring to FIGS. 1*a* to 1*g*, a body care tool 100 according to an embodiment of the invention is provided. The body care tool 100 comprises a body interacting structure 104—such as, for example, a scrubber as illustrated—for interacting with a surface portion of the body. Handle 102 is connected to the body interacting structure 104. The handle 102 can comprise a handle member 103 having a plurality of finger apertures 106 disposed therein. Each finger aperture 106 is designed for accommodating one finger of a user of the body care tool 100 therein such that the user is enabled to handle the body interacting structure 104—i.e. moving the body interacting structure 104 over a respective surface portion of the body while simultaneously applying pressure to press the body interacting structure 104 onto the surface portion of the body—using two or more fingers inserted into the finger apertures 106, as will be described in more detail hereinbelow.

The handle member 103 can have an elongated shape extending from the body interacting structure 104 with the finger apertures 106 being disposed at different distances to the body interacting structure 104 along the handle member 103. The handle member 103 comprises, in one case, five finger apertures 106 in order to provide sufficient flexibility for the user to choose a combination of fingers—thumb, index finger, middle finger, ring finger, and little finger—of both hands with respective finger apertures 106 that provides proper handling of the body care tool 100. For example, the user might choose different combinations for reaching different parts of his/her body, as will be illustrated in more detail hereinbelow. Of course, the number of finger apertures 106 is not limited to five, but other numbers of finger apertures 106 such as, for example, two, three, four, six, or more may be employed depending on the size and type of the body care tool 100.

The finger apertures 106 can be disposed along a substantially straight line in a substantially equidistant fashion with the finger apertures 106 having a circular cross section of a substantially same size. The shape of the cross section, the size of the cross section D1, and the distance D2 between two adjacent finger apertures 106 have been determined such that a user having an approximately average sized hand is enabled to easily insert his/her fingers into the finger apertures 106 in various combinations and to remove the same therefrom while sufficient interaction between the user's fingers and the inside walls of the finger apertures 106 is provided during handling of the body care tool 100 in order to enable proper handling absent gripping of the handle element 103. Of course, the provision of the finger apertures 106 is adaptable to custom design the handle element 103 for different sized hands and to take into account a deformation of a user's hand by: providing different shaped cross sections of the finger apertures 106 such as an oval cross section; providing different sized finger apertures 106—for example, a larger sized finger aperture 106 for accommodating a user's thumb therein; providing the finger apertures 106 other than along a straight line—for example, along a curved line; providing the finger apertures 106 other than in an equidistant fashion—for example, providing a larger distance between a finger aperture 106 intended for accommodating a thumb and an adjacent finger aperture 106 intended for accommodating an index finger; and, providing one or more finger apertures 106 having a different orientation of the longitudinal axis 118—for example, to accommodate a deformed finger.

The body care tool 100 can comprise a connecting interface disposed between the body interacting structure 104 and the handle 102 for removably connecting the handle 102 to the body interacting structure 104. For example, the handle 102 comprises a fork-shaped interacting element 108 for receiving through gap 120 between fork arms 108A and 108B a respective interacting portion of the scrubber 104 and an interacting bore 116 for holding the interacting portion of the scrubber 104 therein. For example, the interacting portion of the scrubber 104 is made of a flexible material that is compressed during insertion through the gap 114 and expanded when disposed in the interacting bore 116. To further secure the scrubber 104, a loop 112 mounted to the scrubber 104 is secured via protrusion 110. The same type of connecting interface is employable for use with a sponge type body interacting structure 104. As is evident to one skilled in the art, there are numerous other types of conventional connecting interfaces employable such as, for example, a threaded fastener, or a hook and loop fastener such as Velcro™, for removably connecting various types of body interacting structure 104 such as, for example, scrubbers, brushes, sponges, or massaging devices.

Figure 1C:
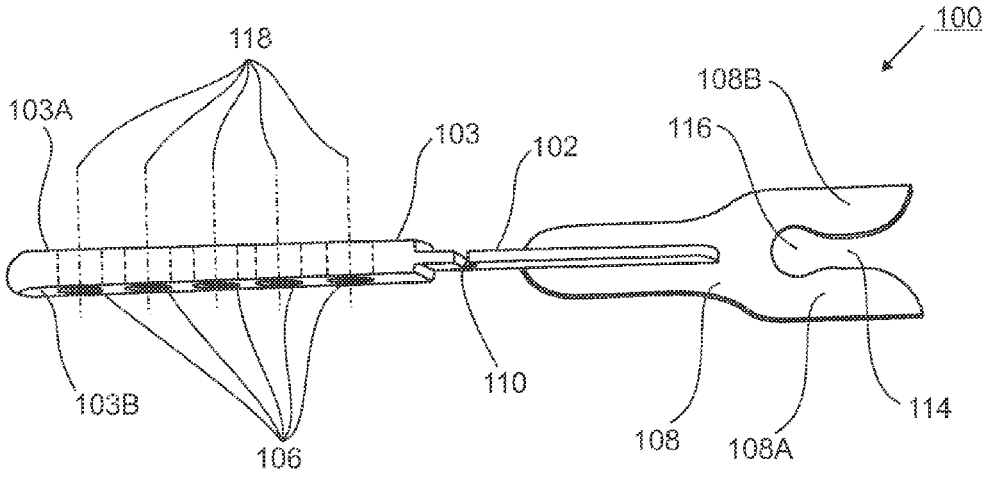
FIG. 1*c* is a simplified block diagram illustrating a perspective top view of the handle of the body care tool according to an embodiment of the invention illustrated in FIG. 1*a;*
Figure 1D:
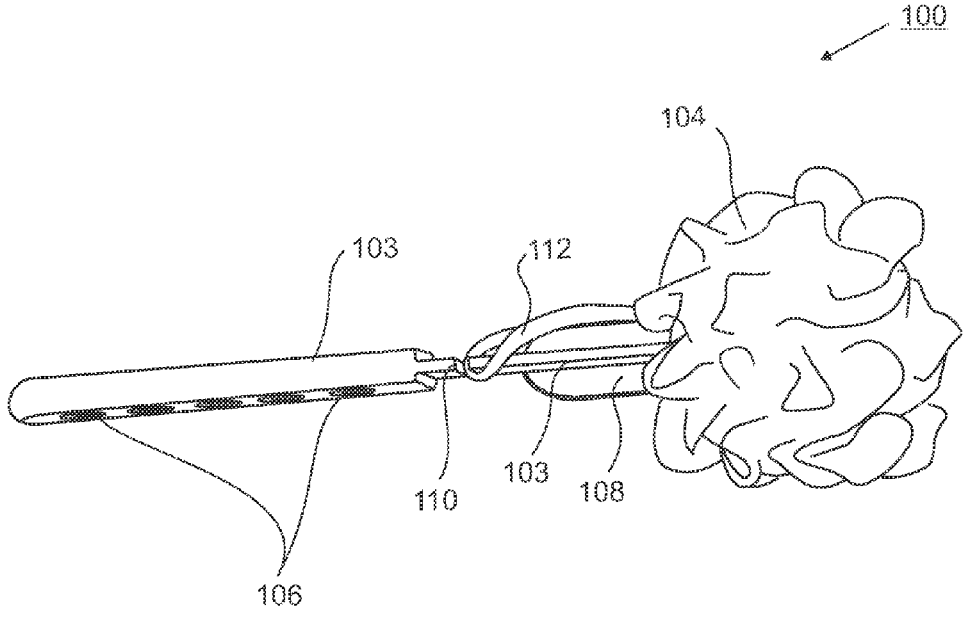
FIG. 1*d* is a simplified block diagram illustrating a perspective top view of the body care tool according to an embodiment of the invention illustrated in FIG. 1*a;*
Figure 1E:
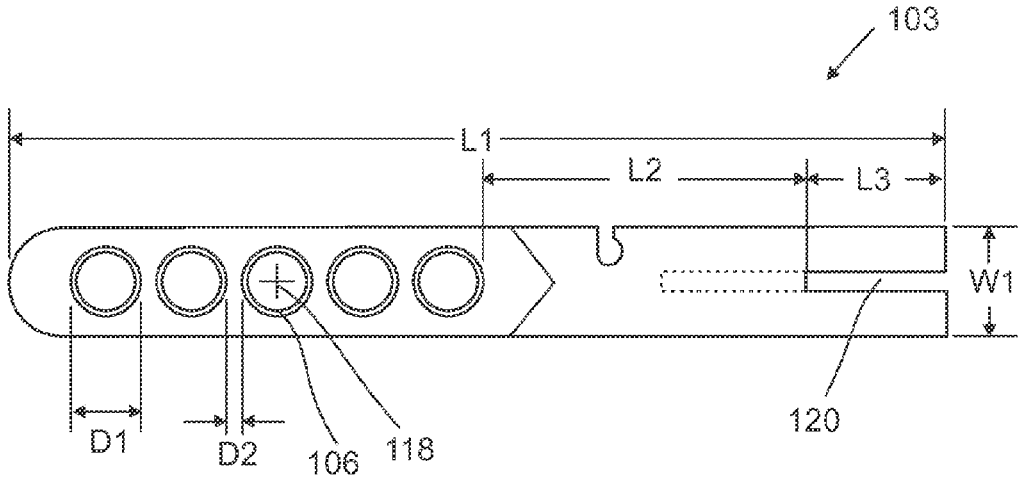
FIGS. 1*e* and 1*f* are simplified block diagrams illustrating a side view and a top view, respectively, of the handle element of the body care tool according to an embodiment of the invention illustrated in FIG. 1*a;*
Figure 1F:
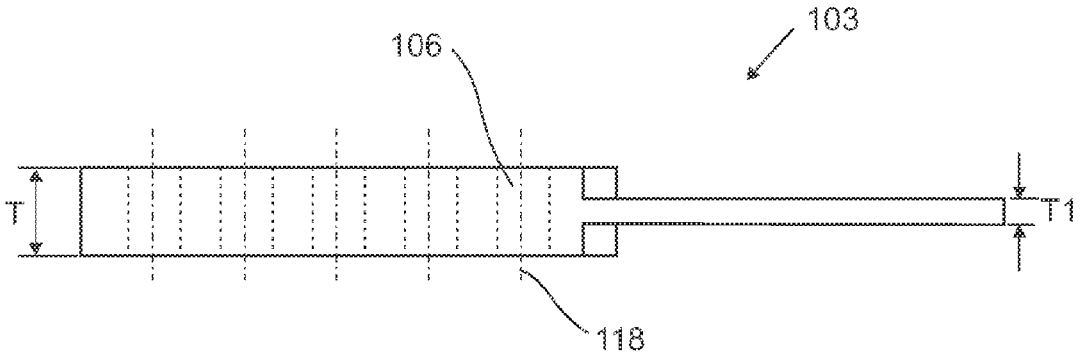
Figure 1G:
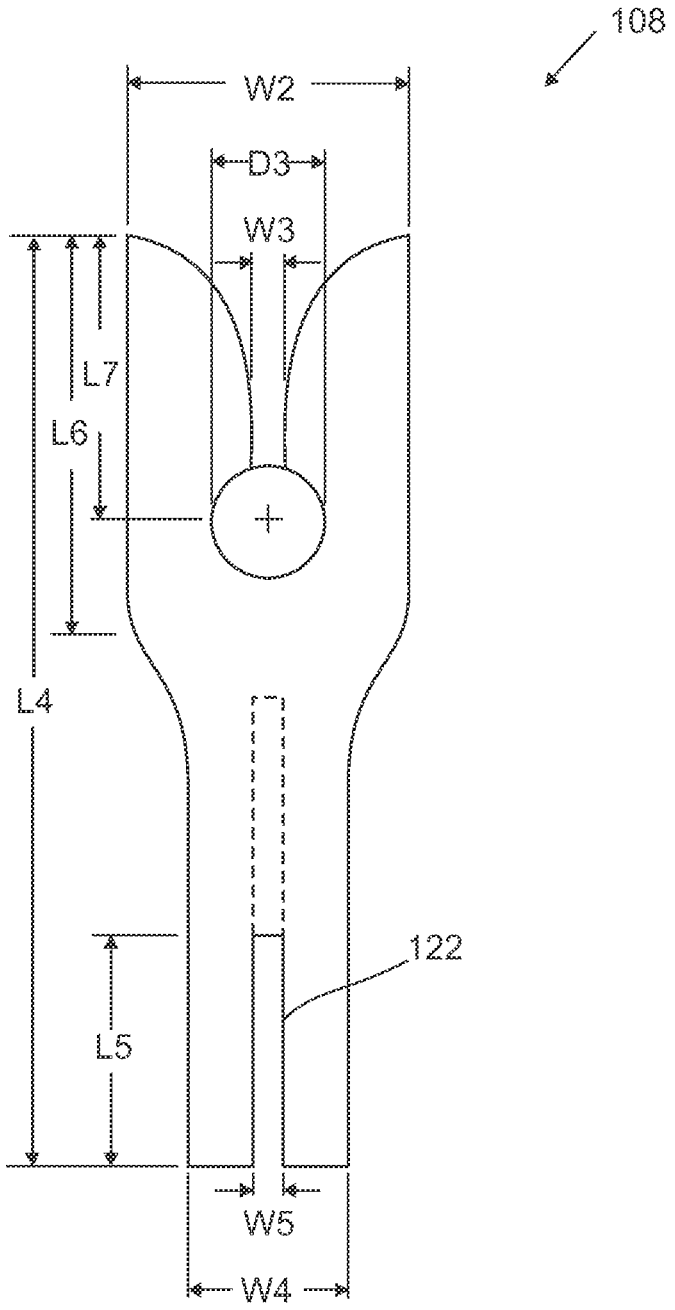
FIG. 1*g* is a simplified block diagram illustrating a top view of the interacting element of the body care tool according to an embodiment of the invention illustrated in FIG. 1*a*; and, FIGS. 2*a* to 2*d* are simplified block diagrams illustrating the handling of the body care tool according to an embodiment of the invention illustrated in FIG. 1*a*.

In an exemplary implementation, the body care tool 100 has been implemented as illustrated in FIGS. 1*e* to 1*g* with the handle 102 being composed of two parts—the handle element 103 and the interacting element 108—which are made of a wood material suitable for use in water such as, for example, poly urethane coated mahogany or oak wood and joined via joining gaps 120 and 122 in a conventional manner using a suitable adhesive.

The handle element 103, illustrated in FIGS. 1*e* and 1*f*, can have an overall length L1 of 13.5 inches and lengths L2 and L3 of 4.5 inches and 2.0 inches, respectively, and a width W1 of 1.5 inch. The finger apertures 106 can be provided as bores drilled in the handle element 103 having a diameter D1 of 1.0 inch and placed in an equidistant fashion with a distance D2 of ⅜ inch between adjacent finger apertures 106. The edges of the bores and the handle element 103 may be sufficiently rounded or beveled to prevent cuts when inserting/removing a finger and during handling of the body care tool 100. The handle element 103 can have a thickness T at a first portion where the finger apertures 106 are disposed and a thickness T1 at a second portion where the interacting element 108 is mounted thereto, with T being 0.75 inch and T1 being 0.25 inch. The thickness T has been determined such that the handle element 103 is sufficiently thick to provide sufficient interaction between the user's fingers and the inside walls of the finger apertures 106 during handling of the body care tool 100 while the handle element 103 is also sufficiently thin to facilitate inserting/removing of the fingers into/from the finger apertures 106.

The interacting element 108, illustrated in FIG. 1*g*, can be 0.25 inch thick, have the lengths L4, L5, L6, and L7 of 8.0 inches, 2.0 inches, 3.5 inches, and 2.5 inches, respectively, and the widths W2, W3, W4, and W5 of 2.5 inches, 0.5 inch, 1.5 inch, and 0.25 inch. The diameter D3 of the bore 116 can be 1.0 inch.

Alternatively, handle element 103 or the interacting element 108 or the body interacting structure 104 or the entire body care tool 100 is made, for example, in one piece of a suitable plastic material such as, for example, PolyVinyl Chloride (PVC) or Nylon, using a conventional plastic molding process or a suitable metal such as, for example, aluminum.

Of course, one skilled in the art will arrive at numerous different designs of the handle 102 with the handle 102 having, for example, different dimensions and different shapes.

Figure 2A:
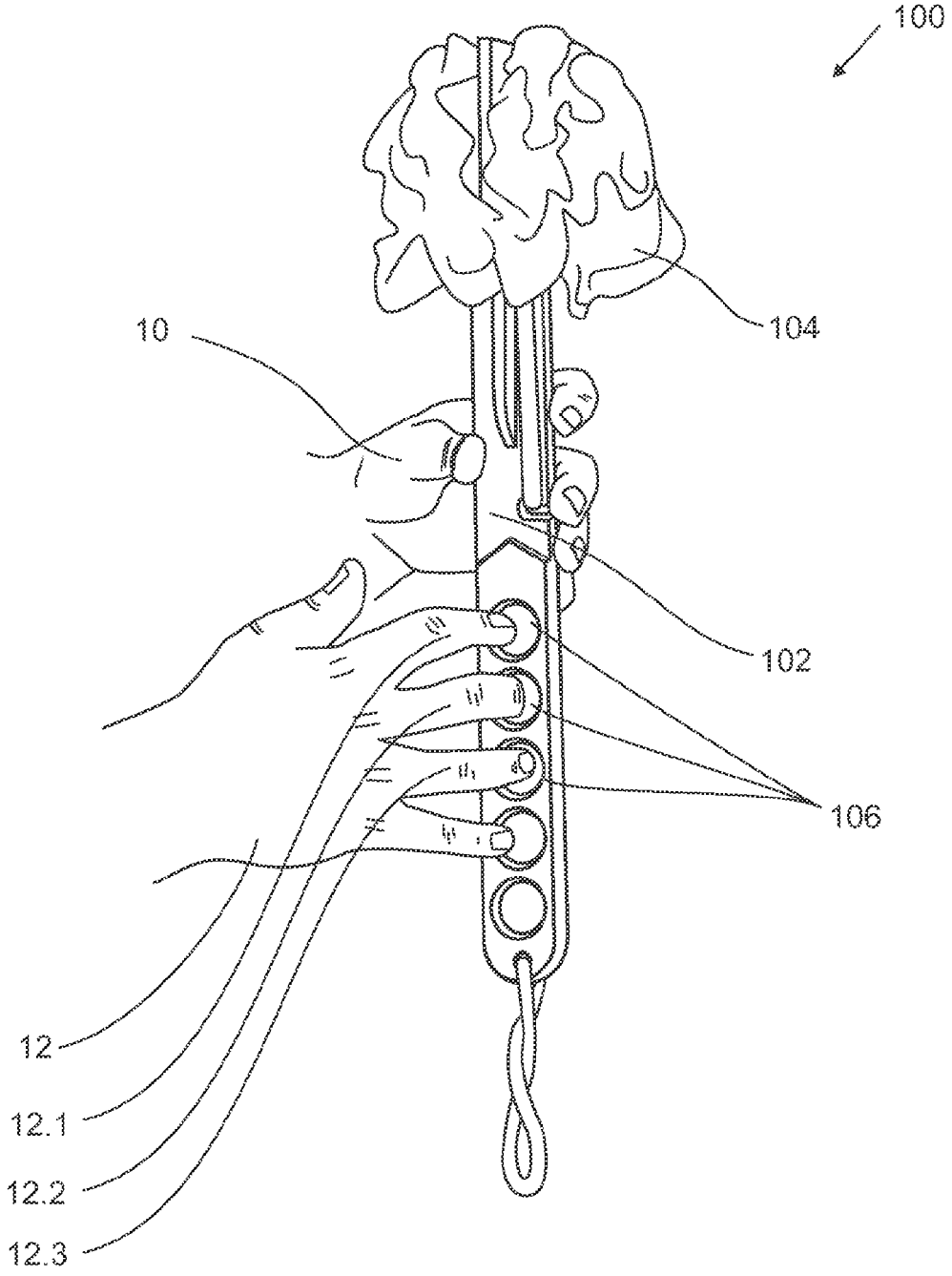
Figure 2B:
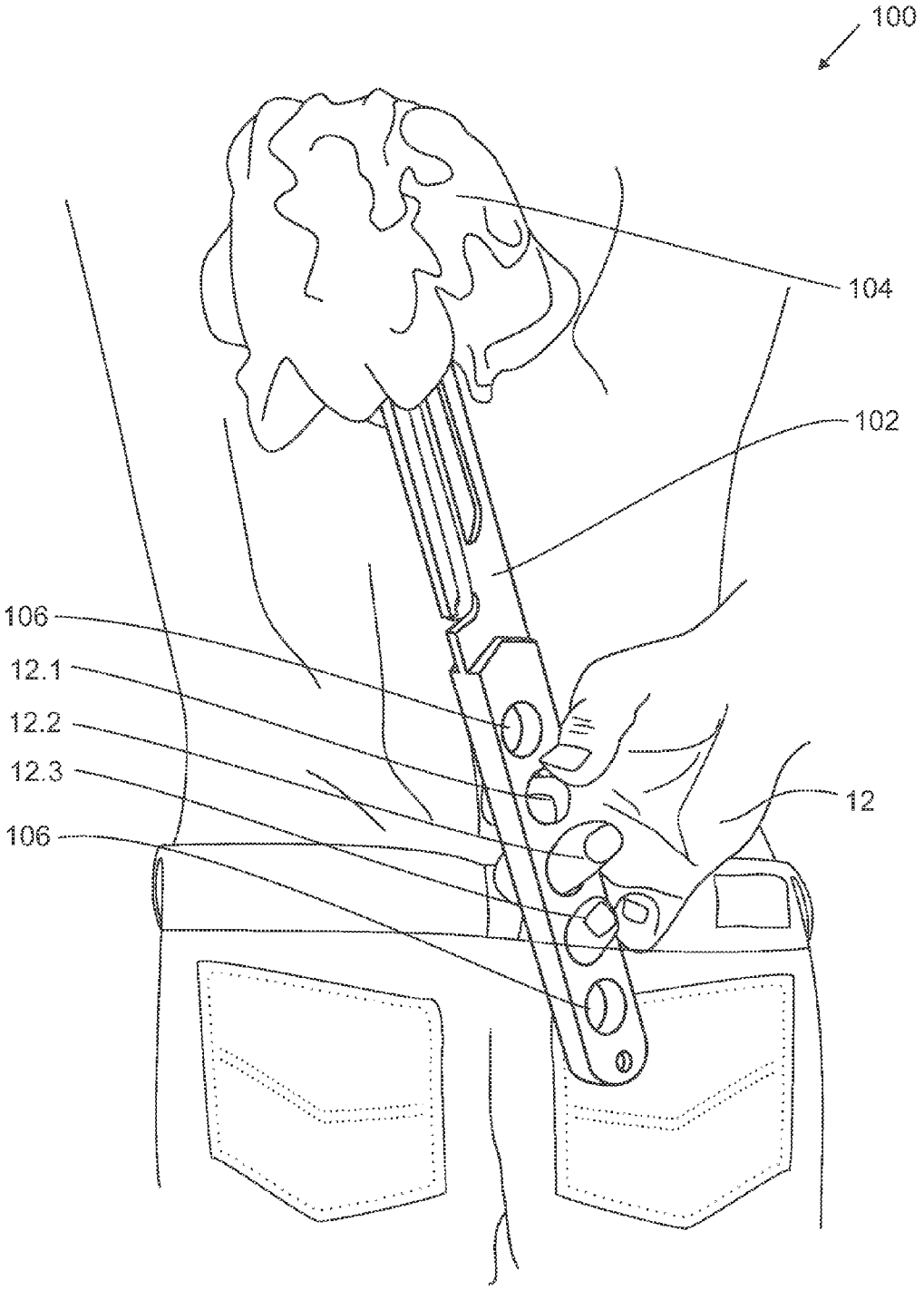
Figure 2C:
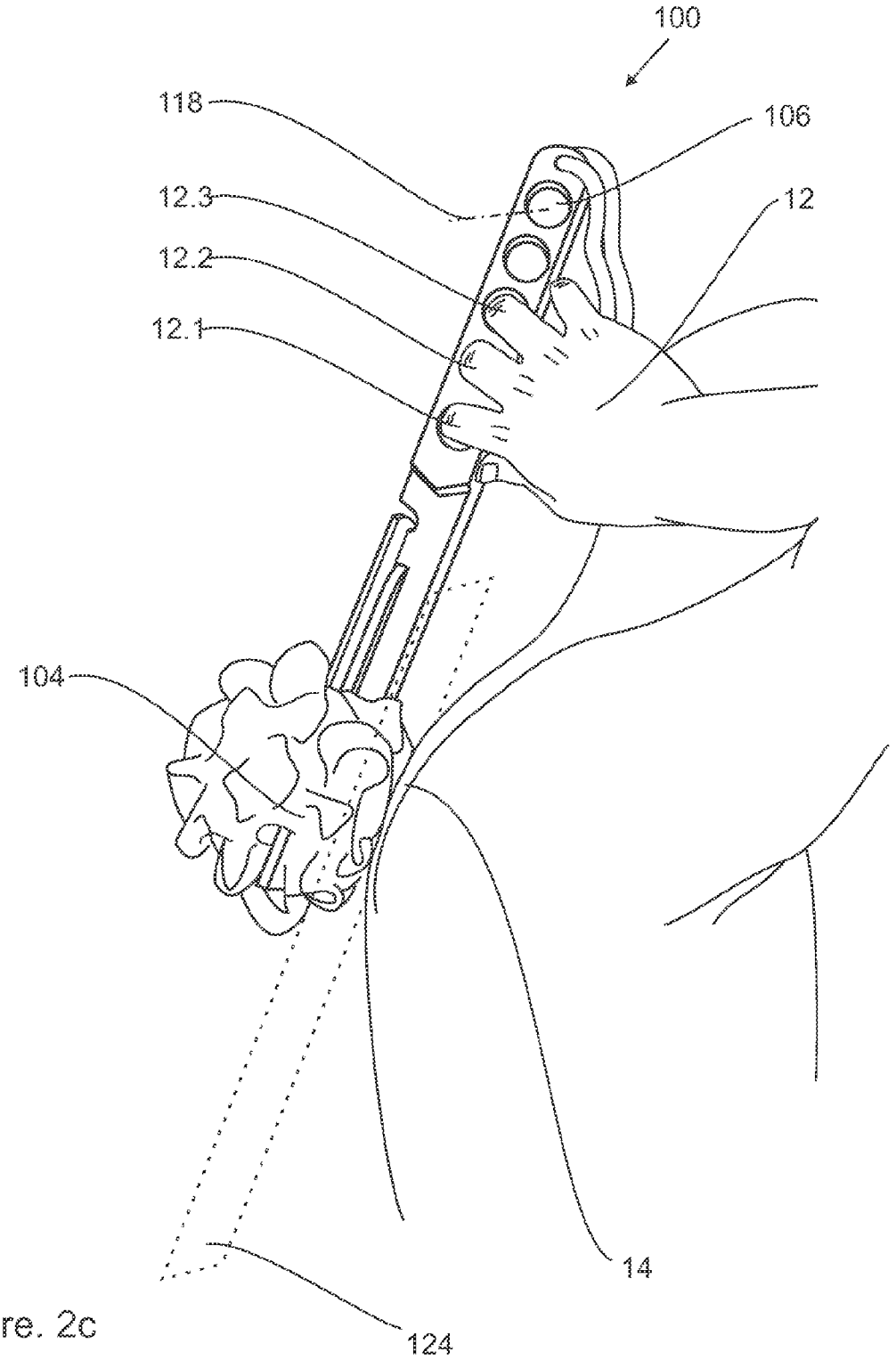

Referring to FIGS. 2*a* to 2*d*, the handling of the body care tool 100 is illustrated. For example, as shown in FIG. 2*a*, the user slightly holds the body care tool 100 in the left hand 10 while inserting index finger 12.1, middle finger 12.2, and ring finger 12.3 of the right hand 12 into respective finger apertures 106. FIGS. 2*b* and 2*c* illustrated two variations of the handling of the body care tool 100 with the fingers 12.1, 12.2, and 12.3 inserted in respective finger apertures 106 for handling body care tool 100 while scrubbing the back.

As illustrated in FIG. 2*c*, the body interacting structure 104 interacts with the surface portion of the body by moving the same in a plane of operation 124 oriented approximately parallel to the surface portion of the body. The bore of each of the finger apertures 106 can be oriented with respect to the body interacting structure 104 such that its longitudinal axis 118 is oriented approximately parallel to the plane of operation 124. The handle member 103 can comprise a substantially flat first and second side surface 103A, 103B, as illustrated in FIG. 1*c*, with the first and second side surface 103A, 103B being oriented substantially perpendicular to the longitudinal axis 118 of the bore of each of the finger apertures 106 and, therefore, also being oriented substantially perpendicular to the plane of operation 124.

Figure 2D:
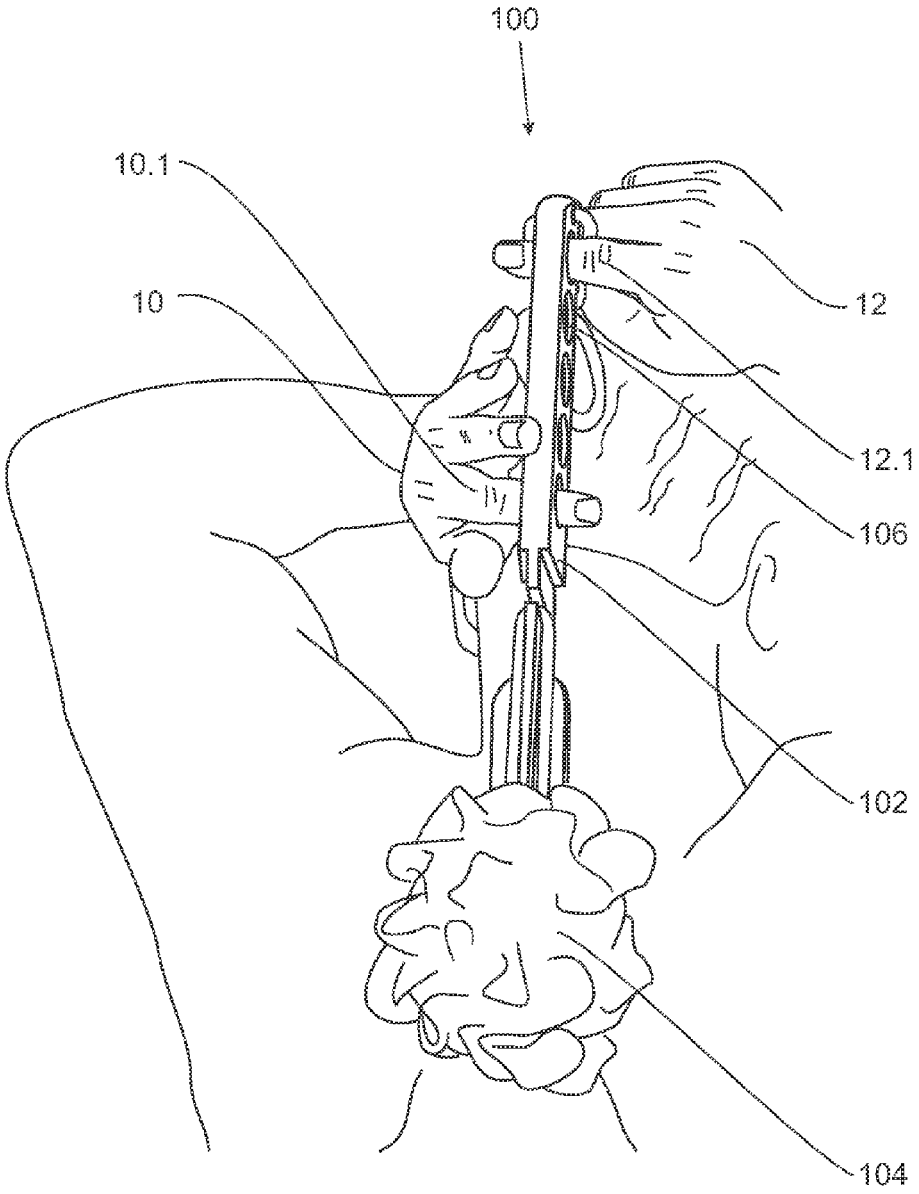

FIG. 2*d* illustrates an alternative handling of the body care tool 100 using one finger of each hand.

The present invention has been described herein with regard to certain embodiments. However, it will be obvious to persons skilled in the art that a number of variations and modifications can be made without departing from the scope of the invention as described herein.

What is claimed is:

1. A body care tool comprising:

a body interacting structure for interacting with a surface portion of the body;

a substantially rigid handle connected to the body interacting structure, the handle having a plurality of finger apertures disposed therein, each finger aperture being designed for accommodating one finger of a user of the body care tool therein such that the user is enabled to handle the body interacting structure using two or more fingers inserted into the finger apertures, the handle having a thickness such that the handle is sufficiently thick for providing sufficient interaction between a user's fingers and inside walls of the finger apertures for enabling handling of the body care tool absent gripping of the handle;

wherein the body interacting structure is designed to interact with the surface portion of the body by moving the same in a plane of operation oriented approximately parallel to the surface portion of the body and wherein a longitudinal axis of the finger apertures is oriented approximately parallel to the plane of operation; and wherein the handle comprises a substantially flat first and second side surface, the first and second side surface being oriented substantially perpendicular to the plane of operation.

2. The body care tool according to claim 1, wherein the handle has an elongated shape extending in substantially one direction from the body interacting structure.

3. The body care tool according to claim 2, wherein the finger apertures are disposed at different distances to the body interacting structure along a portion of the handle.

4. The body care tool according to claim 3, wherein the finger apertures are disposed along a substantially straight line.

5. The body care tool according to claim 3, wherein the finger apertures are disposed in a substantially equidistant fashion.

6. The body care tool according to claim 1, wherein the finger apertures have a substantially same size.

7. The body care tool according to claim 1 comprising a connecting interface disposed between the body interacting structure and the handle, the connecting interface for removably connecting the handle to the body interacting structure.

* * * * *